US009016609B2

(12) United States Patent
Turner et al.

(10) Patent No.: US 9,016,609 B2
(45) Date of Patent: Apr. 28, 2015

(54) MODULAR SYSTEM AND METHOD FOR DEPLOYMENT AND RETRIEVAL OF LARGE DIAMETER HOSES

(71) Applicant: T&CO Energy Services, Inc., Denton, TX (US)

(72) Inventors: Amy B. Turner, Aubrey, TX (US); Michael W. Woods, Denton, TX (US); Robert Bone, Weatherford, TX (US); David Sanders, Sherman, TX (US)

(73) Assignee: T&CO Energy Services, Inc., Denton, TX (US)

( * ) Notice: Subject to any disclaimer, the term of this patent is extended or adjusted under 35 U.S.C. 154(b) by 0 days.

(21) Appl. No.: 14/459,063

(22) Filed: Aug. 13, 2014

(65) Prior Publication Data

US 2014/0346269 A1 Nov. 27, 2014

Related U.S. Application Data

(63) Continuation of application No. 14/057,569, filed on Oct. 18, 2013, now Pat. No. 8,814,075.

(60) Provisional application No. 61/763,307, filed on Feb. 11, 2013.

(51) Int. Cl.
*B65H 75/44* (2006.01)
*B65H 75/42* (2006.01)

(52) U.S. Cl.
CPC ..... *B65H 75/425* (2013.01); *B65H 75/446* (2013.01); *B65H 75/4481* (2013.01); *B65H 2701/332* (2013.01)

(58) Field of Classification Search
CPC ..... B65H 49/32; B65H 49/325; B65H 49/34; B65H 57/12; B65H 57/14; B65H 54/74; B65H 2555/12; B65H 2555/22
USPC ..... 242/390.2, 390.5, 390.6, 393, 399.1, 242/399.2, 403, 559.4; 414/911; 254/323
See application file for complete search history.

(56) References Cited

U.S. PATENT DOCUMENTS

| | | | | |
|---|---|---|---|---|
| 4,148,445 | A * | 4/1979 | Reynolds et al. | 242/388.7 |
| 4,174,809 | A * | 11/1979 | Arlemark | 239/745 |
| 4,588,142 | A * | 5/1986 | Malzacher | 242/390.5 |
| 4,767,073 | A * | 8/1988 | Malzacher | 242/414 |
| 5,332,166 | A * | 7/1994 | Kepes | 242/390.2 |
| 5,402,959 | A * | 4/1995 | Wadle | 242/472.6 |
| 6,347,761 | B1 * | 2/2002 | Larson | 242/390.5 |
| 6,932,294 | B1 * | 8/2005 | Larson | 242/390.5 |

* cited by examiner

*Primary Examiner* — William A Rivera
(74) *Attorney, Agent, or Firm* — Bell Nunnally & Martin LLP; Craig J. Cox

(57) ABSTRACT

A hose deployment and retrieval system is described that includes a modular reel assembly. The modular reel assembly includes a reel having a hub around which a hose may be wound and a wheel assembly on either side of the hub and spaced to accept the hose there between. The reel assembly also includes an axle in the center of the hub around which the hub can spin and a base holding the axle. A deployment fork assembly includes a reel assembly mount for engaging with the modular reel assembly and a drive mechanism to spin the reel when the deployment fork assembly is engaged with the modular reel assembly, wherein the deployment fork assembly is adapted to mount to a vehicle.

14 Claims, 12 Drawing Sheets

MODULAR SYSTEM AND METHOD FOR DEPLOYMENT AND RETRIEVAL OF LARGE DIAMETER HOSES

CROSS REFERENCE TO RELATED INFORMATION

This application is a continuation of U.S. patent application Ser. No. 14/057,569 (now U.S. Pat. No. 8,814,075), filed Oct. 18, 2013, titled "Modular System and Method for Deployment and Retrieval of Large Diameter Hoses", which claims the benefit of U.S. Provisional Patent Application No. 61/763,307, filed Feb. 11, 2013, the contents of which are hereby incorporated herein in its entirety.

TECHNICAL FIELD

The present disclosure is directed to deployment systems for large diameter hoses, and more specifically modular hose deployment systems.

BACKGROUND OF THE INVENTION

Many applications require running hoses for water or other materials over large distances from a water source to the site where the water is required. Those applications include oil and gas drilling and hydraulic fracturing. The distances between the water source and the site can be anywhere from hundreds of yards to several miles or more, and typically are across undeveloped land such as fields, woods, creek beds and the like. A preferred method of moving water is to run a large diameter hose, which can be several inches or more, from the source to the site. The hoses come in segments that can be of any length, but are usually several hundred yards long.

Deploying and retrieving those hoses over those distances and terrains is a time and labor consuming task. The task is done with either folded hoses deployed from trucks or reeled hoses deployed from single purpose vehicles designed specifically for hose deployment. Folded hoses from trucks are very time consuming to deploy and particularly to retrieve. Also folded hoses can be limited in length based on the weight and volume of the folded hose and the method of deployment. Special purpose vehicles are expensive and have no other purpose other than hose deployment and retrieval. The special purpose vehicles must either be left on site while the hose is in use, wasting an expensive resource, or must be shuttled from site to site requiring expense to move the vehicle and scheduling problems.

Instead, what is needed is a modular hose deployment system that can accommodate large long hoses and that can be deployed and retrieved from multipurpose vehicles that are already on site for other purposes, such as forklifts, telehandlers or other similar vehicles.

BRIEF SUMMARY OF THE INVENTION

In a preferred embodiment, a hose deployment and retrieval system is described that includes a modular reel assembly. The modular reel assembly includes a reel having a hub around which a hose may be wound and a wheel assembly on either side of the hub and spaced to accept the hose there between. The reel assembly also includes an axle in the center of the hub around which the hub can spin and a base holding the axle. A deployment fork assembly includes a reel assembly mount for engaging with the modular reel assembly and a drive mechanism to spin the reel when the deployment fork assembly is engaged with the modular reel assembly, wherein the deployment fork assembly is adapted to mount to a vehicle.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The system of the present invention allows for the deployment and retrieval of large diameter hoses across undeveloped terrain using general purpose vehicles. The system includes hose reels, each holding one or more sections of hose, and a deployment fork, or cradle that is able to pick up and spin the hose reel. The deployment fork is attachable to general purpose vehicles such as a forklift, telehandler with a fork attachment, or other vehicle with an appropriate interface to pick up and provide power to the deployment fork.

Figure 1:
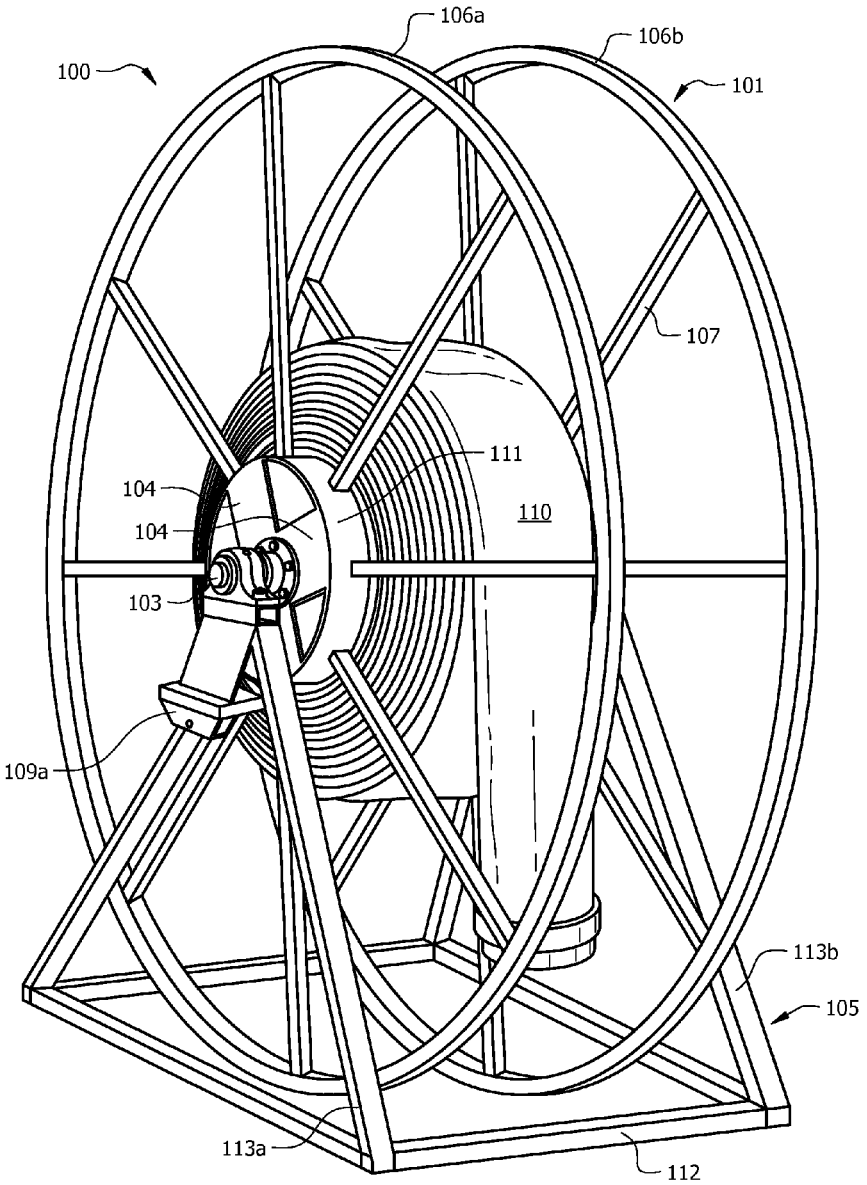
FIG. 1 is a perspective view of an embodiment of a modular hose deployment reel according to the concepts described herein.

Referring now to FIG. 1, a preferred embodiment of a modular reel assembly is shown. Modular reel assembly is formed by reel assembly 101 and base assembly 105 connected at axle 103. Base assembly is formed by base 112 and support triangles 103*a* and 103*b* that hold axle 103. Base assembly allows the modular reel assembly 100 to be placed on the ground in a stable orientation. The base assembly 105 supports the reel 101 at the axle 103. The reel assembly 101 is formed by a center hub 102 (shown with reference to FIG. 2) connected to axle 103 by spokes 104 and two wheel assemblies 106*a* and 106*b* spaced to accept the hose in between. A drive surface 111 is formed where the hub extends out beyond the wheel assembly 106*a* on the drive side of the modular hose reel 100.

The hose 110 winds around the hub and is contained between the wheel assemblies 106*a* and 106*b*. The wheel assemblies 106*a* and 106*b* are formed by an outer band connected to the hub by a series of spokes 107. The diameter of the wheel is preferably determined by the size of the hose wound onto the reel. The hose when fully wound should be contained completely within the wheel assemblies 106*a* and 106*b*, including the end attachment portion of the hose. For most applications a wheel diameter of 6 to 10 feet is appropriate, though any size wheel could be used. Attached to the base assembly 105, just below the axle 103 is the deployment fork connection point 109*a* and 109*b* (not shown). The deployment fork connection point includes a block that fits into a cup assembly on the deployment fork as will be discussed below.

Figure 2:
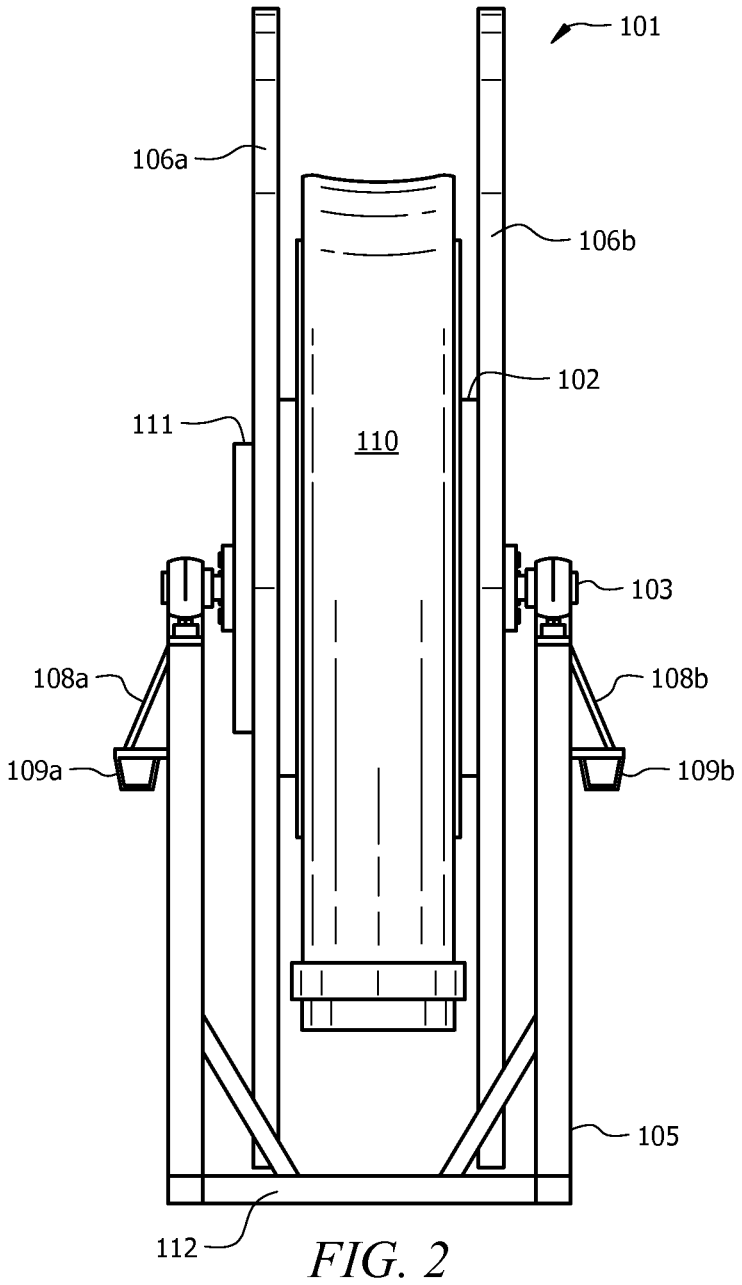
FIG. 2 is a front view of the modular hose reel of FIG. 1.

Referring now to FIG. 2, an end view of the embodiment of modular reel assembly 100 is shown. The wheel assemblies 106*a* and 106*b* are spaced on the hub 102 at a diameter sufficient to hold the collapsed hose in the desired orientation. The wheel assemblies for a reel designed to hold a particular sized hose should be spaced apart at a distance slightly greater than the collapsed width of the hose 110 allowing enough space to easily guide the hose onto the reel but close enough together that the hose stacks neatly upon itself.

Drive surface 111 of hub 102 is shown extending beyond wheel assembly 106*a* while hub 102 is flush with wheel assembly 106*b*. Drive surface 111 accepts a drive wheel mounted on deployment fork as will be described in greater detail below. The drive surface 111 is preferably sized to fit the drive wheel which can be chosen based on the power requirements to turn the reel to deploy and rewind the hose. Again, while a smooth surface appropriate for a friction drive is shown, the surface could include cogs to receive a geared drive wheel. Additionally, other types of drive schemes could be used, including drive schemes that turn the axle instead of the hub. Deployment fork connection points 109*a* and 109*b* extend out from the sides of base 105 and are supported by plates 108*a* and 108*b* which provide sufficient strength for deployment fork connection points 109*a* and 109*b* to carry the weight of modular hose reel 100 when it is connected to the deployment fork and lifted. As stated above, reel assembly 101 connects to base assembly 105 at axle 103. Base 112 supports modular hose reel 100 when it is resting on the ground.

Figure 3:
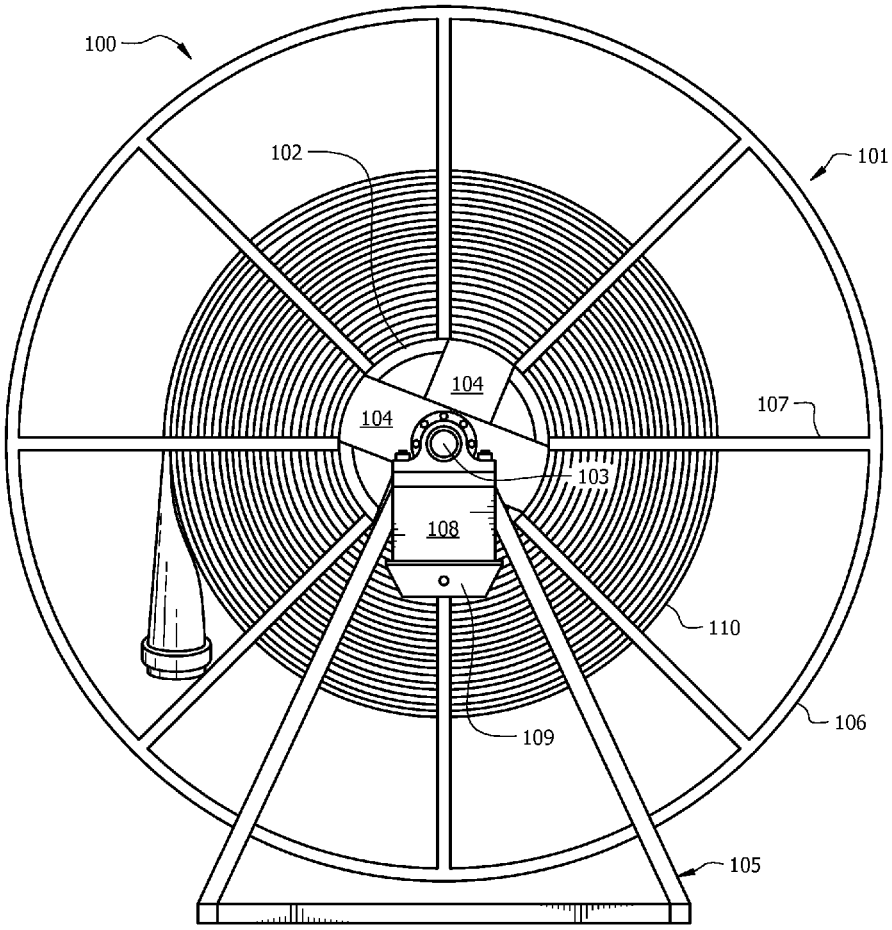
FIG. 3 is a side view of the modular hose reel of FIG. 1.
Figure 4:
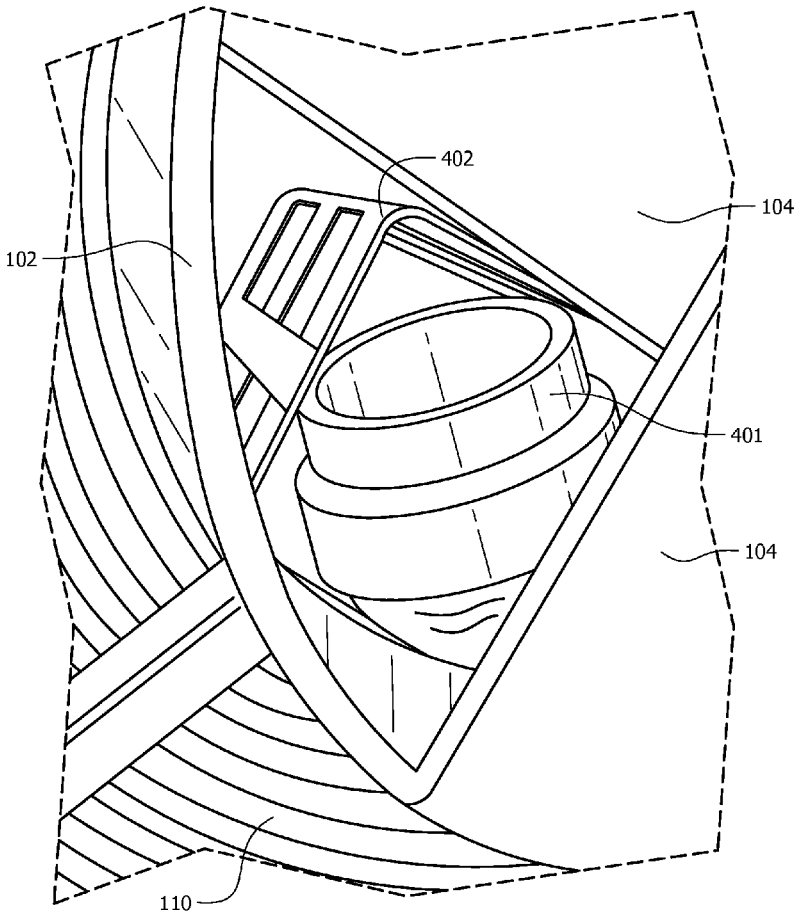
FIG. 4 is a perspective view of an embodiment of a coupling recess in a modular hose reel according to the concepts described herein.
Figure 5:
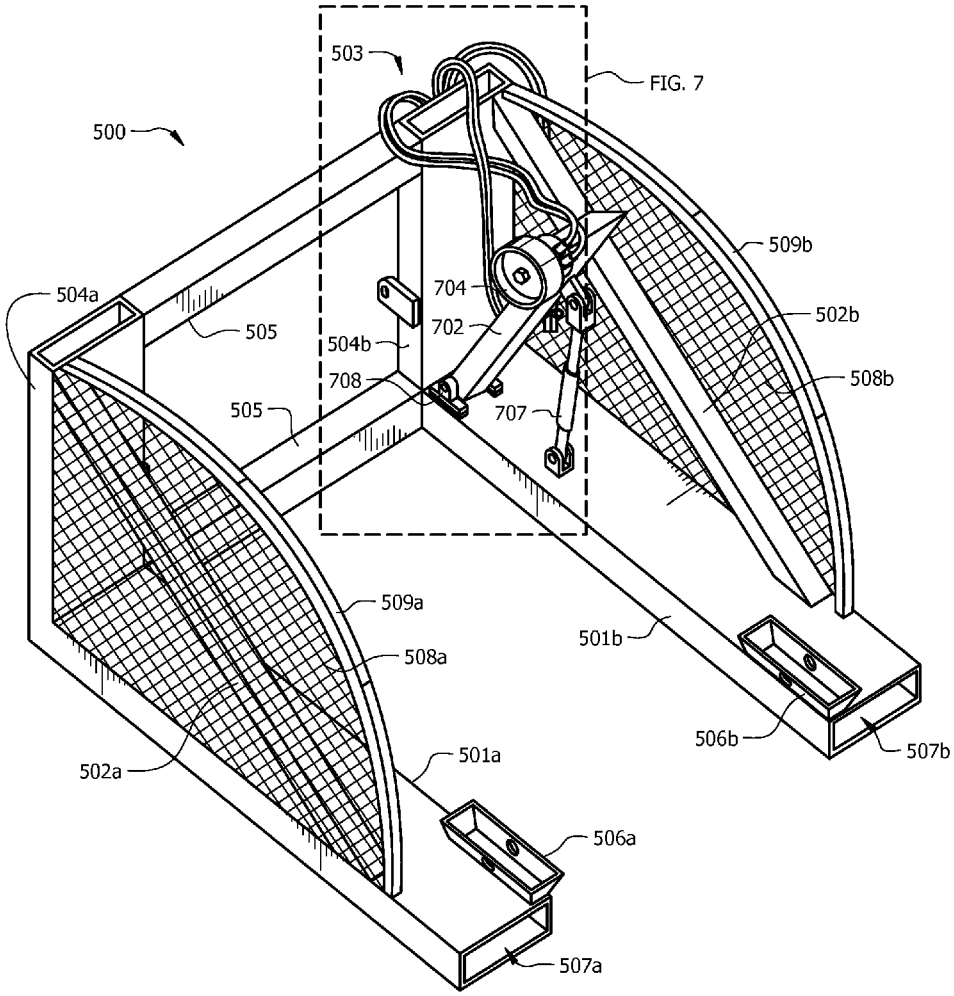
FIG. 5 is a front perspective view of an embodiment of a deployment fork, or base, for use with a modular hose reel according to the concepts described herein.

Referring now to FIG. 3, a side view of the modular hose reel is shown. Elements of modular hose reel 100 are as described with reference to FIGS. 1 and 2. FIG. 5 shows a close up of the interior of the hub 102. In preferred embodiments, a chamber can be created by forming a hole in the hub 102 to allow the connector assembly 401 from the hose to be inserted into a cage 402 out of the way of the rest of the hose. This allows the hose to lay flat against the outer surface of the hub 102 and prevents the hose from being off center of the reel center when it is wound.

Figure 6:
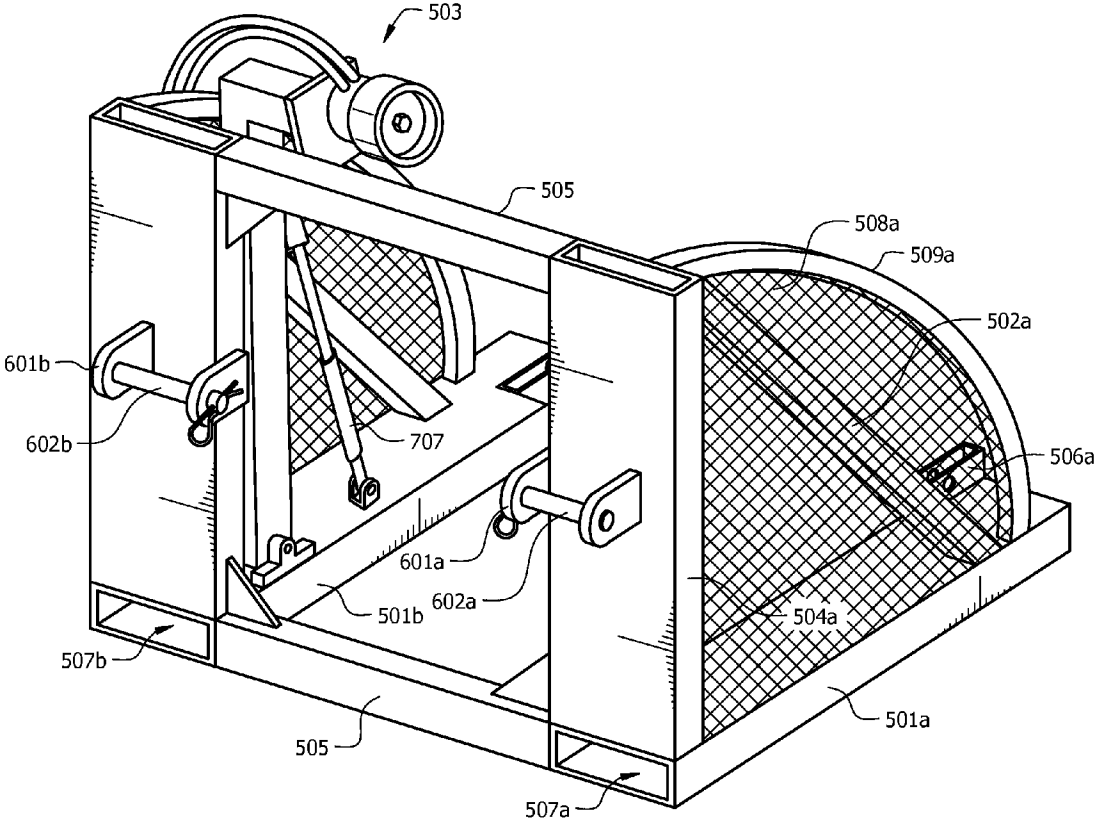
FIG. 6 is a rear perspective view of the deployment fork from FIG. 5.

Referring now to FIGS. 5 and 6, a preferred embodiment of a deployment fork 500 for use with the modular reel assembly is shown. The deployment fork 500 includes a back assembly formed by elements 505 and 504*a* and 504*b*. Fork receivers 501*a* and 501*b* extend from the back assembly bottom of the deployment fork 500. Braces 502*a* and 502*b* connect the fork receivers and elements 504*a* and 504*b* of the back and provide structural integrity. The ends of the fork receiving elements opposite the back include hose reel assembly connection points 506*a* and 506*b*. A protective screen 508*a* and 508*b* can be mounted alongside braces 502*a* and 502*b* using screen rails 509*a* and 509*b*.

Deployment fork 500 also includes a drive arm 702 on the fork receiver 501*b* that will engage with the side of the reel assembly that includes the drive surface. In preferred embodiments, drive arm 702 is moved between an engaged and disengaged position along pivot 708 using hydraulic piston 707. In the engaged position, drive wheel 704 is in contact with drive surface 111 from FIG. 1. The drive arm assembly will be described in greater detail with reference to FIG. 7.

FIG. 6 shows the back of deployment fork 500 where it mounts to a vehicle. In the preferred embodiment, a fork mount is used. Forks from the vehicle slide into interiors 507*a* and 507*b* of the fork receivers 501*a* and 501*b* along the base. Pin locks 601*a* and 601*b* secure the deployment fork 500 to the vertical portions of the forks using the pins 602*a* and 602*b*.

Figure 7:
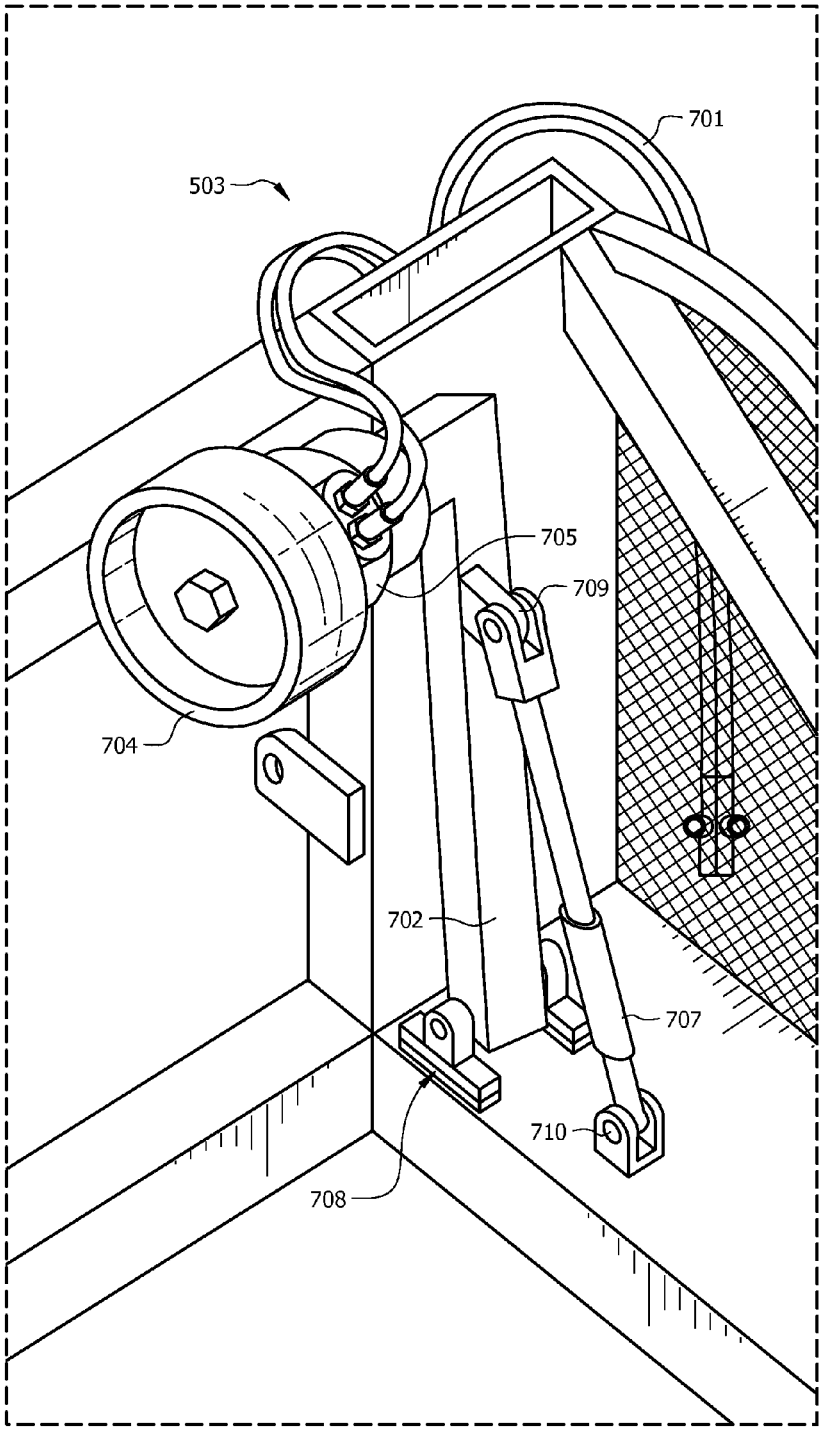
FIG. 7 is a close-up perspective view of an embodiment of a drive mechanism on the deployment fork of FIG. 5.

Referring now to FIG. 7, an embodiment of the drive wheel assembly 503 is shown. Drive wheel assembly 503 is mounted on deployment fork 500 and includes a drive wheel 704 at the end of drive arm 702. Drive arm 702 pivots along pivot 708 to allow it to be engaged and disengaged from the drive surface. Hydraulic piston 707 is used to move drive arm 702 and drive wheel 703 between the engaged (not shown) and disengaged (shown) position. As piston 707 contracts, it pulls drive arm 702 down using pivot points 709 and 710. Drive arm 702 pivots along pivot point 708. Power to the drive wheel 704 and drive wheel motor 705 can be supplied by any suitable mechanism, including electrical, hydraulic power, internal combustion engines or other suitable source. The power source can be mounted to the deployment fork 500, but is preferably drawn from the general purpose vehicle manipulating the hose system. In a preferred embodiment, the drive motor 705 is connected using hydraulic hoses 701 to the auxiliary hydraulic line of the telehandler or other vehicle.

Figure 8:
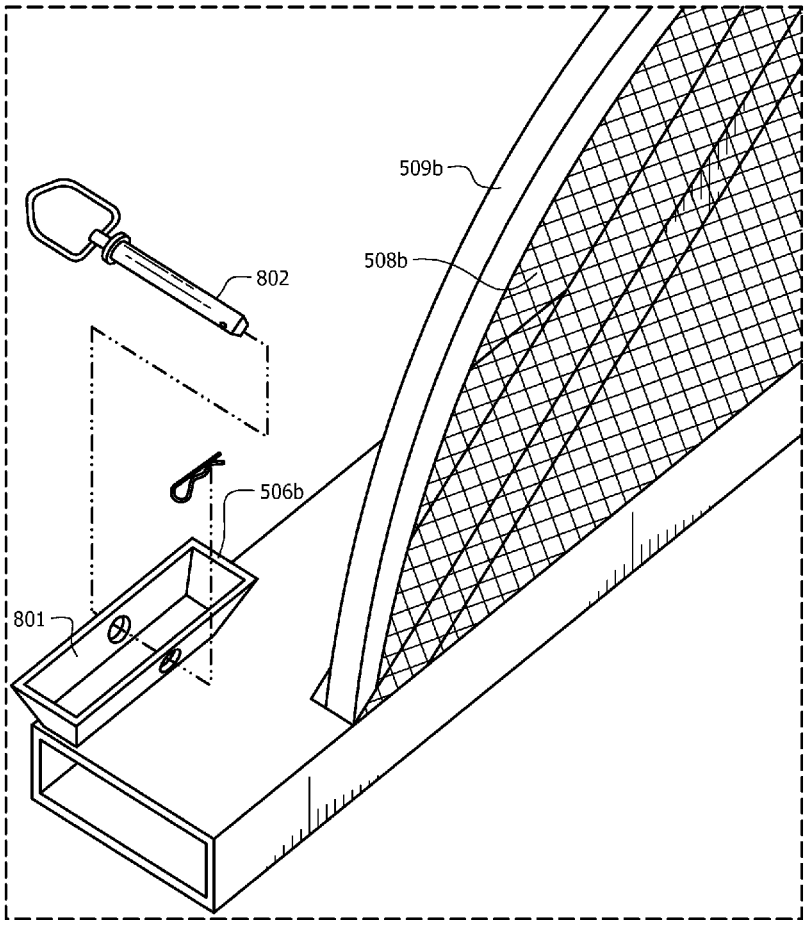
FIG. 8 is a close-up perspective view of an embodiment of a hose reel connection mechanism on the deployment fork of FIG. 5.

FIG. 8 is a close up of a preferred embodiment of a hose reel assembly receiving mount. Cup 506*b* is sized to receive the corresponding block 109 from FIG. 1 on the base of the hose reel assembly. The block fits into the cavity 801 in cup 506*b* such that alignment holes on the block and cup line up to allow pin 802 to fit through the hole through the cup and block to secure the reel assembly to the deployment fork. While pin 802 is shown, any type of securing mechanism, such as spring loaded pins, latches, locks, hooks, etc, can be used to help secure the reel assembly to the deployment fork without departing from the scope of the concepts described herein.

Figure 9:
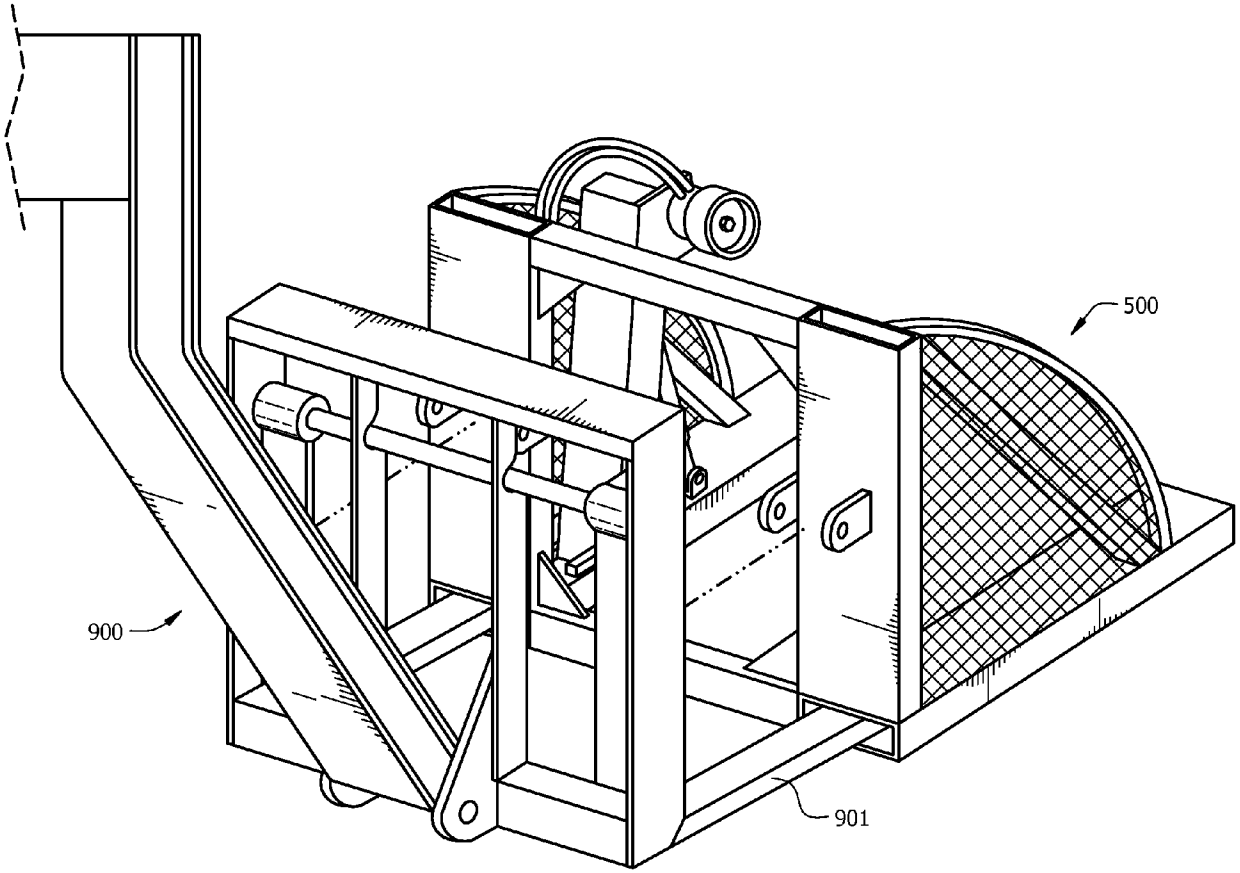
FIG. 9 is a perspective view of the deployment fork of FIG. 5 being engaged by a fork lifting mechanism of a vehicle.
Figure 10:
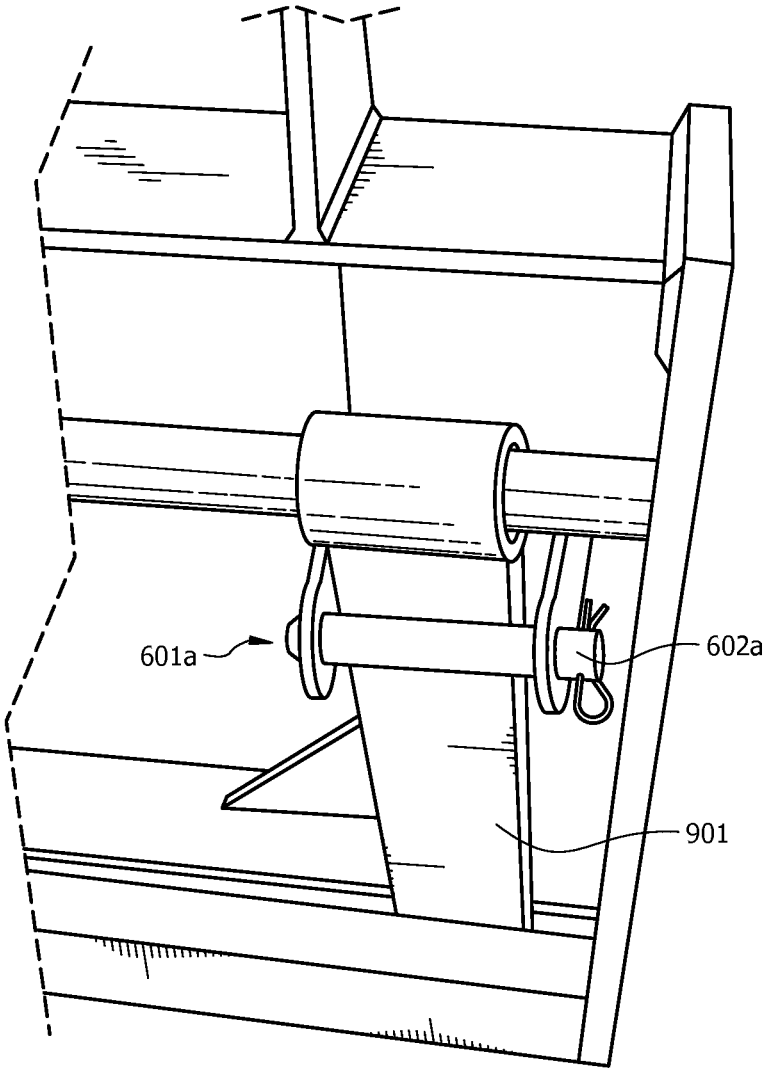
FIG. 10 is a close up view of the connection mechanism between the fork lifting mechanism and the deployment fork of FIG. 5.

FIG. 9 shows an example of a fork attachment 900 on a vehicle, such as a telehandler, engaging with the deployment fork 500. Forks 901 of the fork assembly engage with the fork receivers on the deployment fork 500. Once fully engaged the pin receptacles will align with the vertical portions of the forks. Referring to FIG. 10, the pin assemblies such as assembly 601*a* on the base of the deployment fork 500 securely attach the fork to the deployment base using pin 602*a*.

Figure 11:
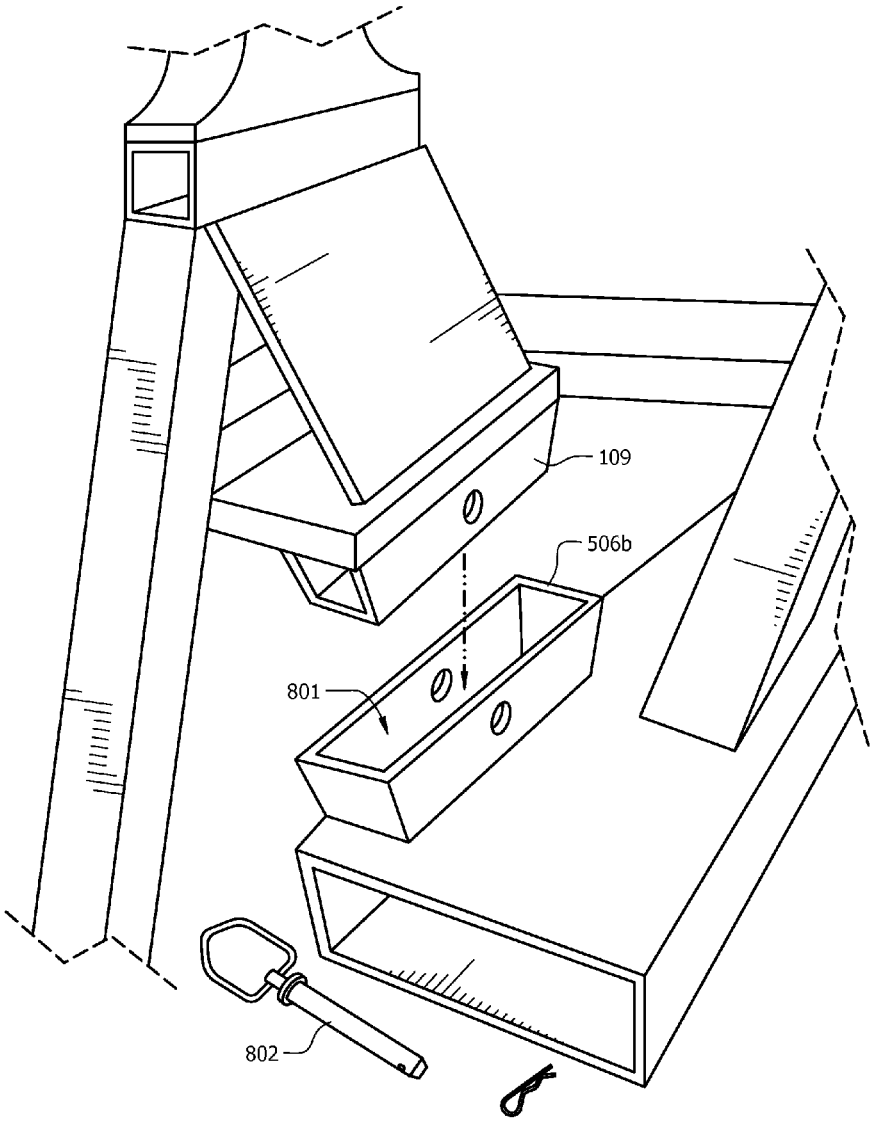
FIG. 11 is a close up view of an embodiment of a connection mechanism between the deployment fork of FIG. 5 and the hose reel of FIG. 1.

Once the deployment fork 500 is attached to the vehicle it can then be used to pick up and operate the hose reel assembly. FIG. 11 shows the deployment fork 500 assembly being engaged with the base of the reel assembly by aligning the recess 801 of cup 506*b* of the deployment fork 500 with the block 109 of the hose reel. Pin 802 is inserted to the pin hole to secure the deployment fork and hose reel assemblies together.

Figure 12:
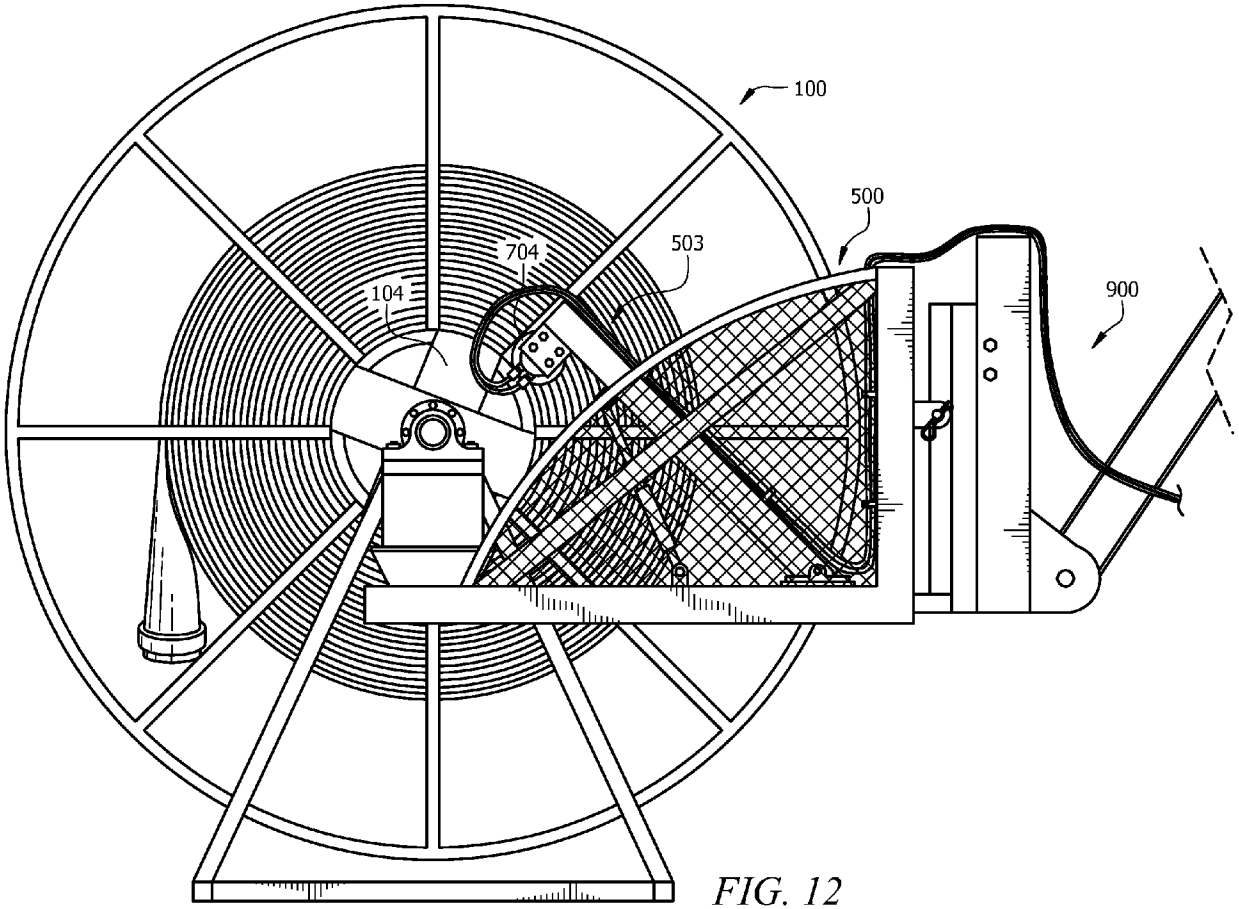
FIG. 12 is a side view showing the hose reel of FIG. 1 engaged with the deployment fork of FIG. 5 engaged with the fork mechanism of a vehicle.

FIG. 12 shows the hose reel assembly 100 mounted on the deployment fork 500, which is engaged with the fork assembly 900 of a vehicle. Drive assembly 503 is in the engaged position with drive wheel 704 engaged with the drive surface 111. Spinning the drive wheel then causes the hose reel to spin along its axis thereby deploying the hose or retrieving the hose depending on the direction the drive wheel is turning. The vehicle can then move along with the spinning of the hose reel to deploy or retrieve the hose over significant distances. Once one hose has been deployed, the vehicle can disengage from that hose reel and pick up another to continue the deployment or retrieval. One vehicle and deployment fork with any number of modular hose reels can then deploy long runs of hoses to get from a water source or drain to a work site.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A modular hose reel assembly for use with a deployment mechanism to retrieve and deploy large diameter hoses, the assembly comprising:

abase formed by two triangular brace elements extending vertically from a rectangular base element;

an axle mount on a top of each triangular brace element;

a connection block assembly connected to an upper end of each triangular base element below the axle mount and extending outwardly from each triangular base element, the connection block assembly providing a connection point to the deployment mechanism; and a wheel assembly connected to the base by an axle engaged with each axle mount, the axle allowing the wheel assembly to spin relative to the base; the wheel assembly including a hub around which the hose can be wound and wheels connected to the hub by spokes, the wheels spaced apart on the hub to allow the hose to fit there between and to hold the hose on the wheel assembly.

2. The modular hose reel assembly of claim 1 further comprising a drive surface to turn the wheel assembly when the modular hose reel is attached to the deployment fork.

3. The modular hose reel assembly of claim 2 wherein the wheel assembly is spun by a drive wheel on the deployment mechanism, the drive wheel engaging with the drive surface on the wheel assembly.

4. The modular hose reel assembly of claim 3 wherein the drive wheel engagement with the drive surface is a friction engagement.

5. The modular hose reel assembly of claim 2 wherein drive surface is formed by a portion of the hub extending beyond the spokes on one side of the modular hose reel assembly.

6. The modular hose reel assembly of claim 1 wherein the hub includes an aperture sized to accept a mating collar on one end of the large diameter hose, thereby allowing the hose to lay essentially flat against the huh when on the modular hose reel assembly.

7. The modular hose reel assembly of claim 1 wherein the wheels are spaced apart on the hub at least six inches.

8. A method for retrieving and deploying a large diameter hose, the method comprising:

attaching a modular reel assembly to a deployment mechanism, the modular reel assembly comprising:

a base formed by two triangular brace elements extending vertically from a rectangular base element;

an axle mount on a top of each triangular brace element;

a connection block assembly connected to an upper end of each triangular base element below the axle mount and extending outwardly from each triangular base element, the connection block assembly providing a connection point to the deployment mechanism; and a wheel assembly connected to the base by an axle engaged with each axle mount, the axle allowing the wheel assembly to spin relative to the base; the wheel assembly including a hub around which the hose can be wound and wheels connected to the hub by spokes, the wheels spaced apart on the hub to allow the hose to fit there between and to hold the hose on the wheel assembly;

using a drive assembly on the deployment mechanism to spin the wheel assembly, wherein the drive assembly spins the wheel assembly in a first direction to deploy the large diameter hose, and the drive mechanism spins the wheel in a second direction, opposite the first direction, to retrieve the large diameter hose; and detaching the modular reel assembly from the deployment mechanism.

9. The method of claim further comprising a drive surface to turn the wheel assembly when the modular hose reel is attached to the deployment fork.

10. The method of claim 9 wherein the wheel assembly is spun by a drive wheel on the deployment mechanism, the drive wheel engaging with the drive surface on the wheel assembly.

11. The method of claim 10 wherein the drive wheel engagement with the drive surface is a friction engagement.

12. The method of claim 9 wherein the drive surface is formed by a portion of the hub extending beyond the spokes on one side of the modular hose reel assembly.

13. The method of claim 8 wherein the huh includes an aperture sized to accept a mating collar on one end of the large diameter hose, thereby allowing the hose to lay essentially flat against the hub when on the modular hose reel assembly.

14. The method of claim 8 wherein the wheels are spaced apart on the hub at least six inches.

* * * * *